US005555687A

United States Patent [19]

Logan et al.

[11] Patent Number: 5,555,687

[45] **Date of Patent: * Sep. 17, 1996**

[54] DECORATIVE MOLDING STRIP SYSTEM

[75] Inventors: Richard Logan, Oxford; Michael C. Clark, Columbiaville; Daniel G. Meyer, Auburn Hills, all of Mich.

[73] Assignee: Mid-America Building Products Corporation, Plymouth, Mich.

[ * ] Notice: The term of this patent shall not extend beyond the expiration date of Pat. No. 5,398,469.

[21] Appl. No.: 366,884

[22] Filed: Dec. 30, 1994

Related U.S. Application Data

[63] Continuation-in-part of Ser. No. 262,918, Jun. 20, 1994, abandoned, which is a continuation-in-part of Ser. No. 143,253, Oct. 26, 1993, Pat. No. 5,457,923, which is a continuation of Ser. No. 916,399, Jul. 20, 1992, abandoned.

[51] Int. Cl.[6] ..... E04F 19/04

[52] U.S. Cl. ..... 52/288.01; 52/287.1; 52/272; 52/716.6; 403/334

[58] Field of Search ..... 52/280, 287, 288.1, 52/253, 255, 241, 272, 716.1, 716.6, 717.05, 717.06, 726.1, 718.04, 718.05; 403/292, 205, 381, 375, 354, 364; 248/345.1

[56] References Cited

U.S. PATENT DOCUMENTS

| | | | |
|---|---|---|---|
| 417,949 | 12/1989 | Sagendorph | 52/287 |
| 1,229,765 | 6/1917 | Lehman | 52/287 |
| 2,114,044 | 4/1938 | Bonnell | 52/280 |
| 3,201,910 | 8/1965 | Keesee | 52/287 |
| 3,271,787 | 9/1966 | Clary | 52/716.2 |
| 3,302,350 | 2/1967 | Brown | 52/287 |
| 3,464,177 | 9/1969 | Amato | 52/288 |
| 3,481,092 | 12/1969 | Constantino | 52/288 |
| 3,616,587 | 11/1971 | Schlafly | 52/288 |
| 4,091,586 | 5/1978 | Schwartz | 52/288 |
| 4,401,705 | 8/1983 | Ewert | 52/717.05 X |
| 4,696,136 | 9/1987 | Grewe | 52/288.1 X |
| 4,709,522 | 12/1987 | Carnahan | 52/287 |
| 5,001,877 | 3/1991 | Edwards | 52/288 |
| 5,131,198 | 7/1992 | Ritchie et al. | 52/288.1 X |
| 5,165,816 | 11/1992 | Parasin | 403/334 |

FOREIGN PATENT DOCUMENTS

| | | | |
|---|---|---|---|
| 7413048 | 4/1976 | Netherlands | 52/288 |
| 567798 | 8/1977 | U.S.S.R. | 52/288 |
| 2191518 | 12/1987 | United Kingdom | 52/288 |

*Primary Examiner*—Carl D. Friedman
*Assistant Examiner*—Winnie Yip
*Attorney, Agent, or Firm*—Barnes, Kisselle, Raisch, Choate, Whittemore & Hulbert, P.C.

[57] ABSTRACT

A decorative molding system removably installed at a ceiling and a vertical wall. The molding system includes a thin molding strip of flexible plastic and a plurality of flexible plastic clips attached at spaced points along the back surface points of the molding strip. A wall track of flexible plastic is mounted adjacent the upper edge of the track on one of the ceiling and said vertical wall. Interengagement is provided on the free end of the clip and the track such that when the thin molding strip with the flexible plastic clips attached thereto is mounted on the track by relative movement, the free end of the clip is moved into the gap and the forward leading edge of the track is engaged. At the juncture of adjacent molding strips, one of the molding strips is provided with a complementary shaped plastic segment spaced from the internal surface of the molding strip to provide a cavity. The other of the molding strips is provided with an axial plastic segment that has a projection of the same configuration adapted to extend into the cavity of an adjacent strip so that adjacent molding strips abut one another with the segment that extends into the cavity of an adjacent strip.

16 Claims, 9 Drawing Sheets

45
48
5
30
35
31
32
46
51
50
49

31a
32a
45a
46a
48a
49a
50a
51a
5
18,19

DECORATIVE MOLDING STRIP SYSTEM

This application is a continuation-in-part of application Ser. No. 08/262,918 filed Jun. 20, 1994 now abandoned which is a continuation-in-part of application Ser. No. 08/143,253 filed Oct. 26, 1993 now U.S. Pat. No. 5,457,923, which is a continuation of application Ser. No. 07/916,399 filed Jul. 20, 1992, abandoned, now continuation application Ser. No. 158,163 filed Nov. 24, 1993.

This invention relates to decorative plastic molding strips used to provide molding about a room.

BACKGROUND AND SUMMARY OF THE INVENTION

In the aforementioned patent applications, there is disclosed a decorative molding strip wherein a thin molding strip of flexible plastic has an upper free edge, lower free edge, a front surface and a back surface. The upper free edge is adapted to lie against the ceiling and flex relative thereto. The lower free edge is adapted to lie against a vertical wall. A plurality of flexible plastic clips are fixed at space points along the thin molding strip along the back surface of the molding strip so that a first end of each clip is attached to the back surface of the molding strip and the free end engages of flexible plastic wall track.

In the aforementioned application Ser. No. 08/262,918 there is disclosed a decorative molding system removably installed at a ceiling and a vertical wall, the molding system comprising a thin molding strip of flexible plastic having an upper free edge, a lower free edge, a front surface and a back surface, the upper free edge is adapted to lie against one of the ceiling and the vertical wall and flex relative thereto. The lower free edge is adapted to lie against the other of said ceiling and said vertical wall and flex relative thereto. A plurality of flexible plastic clips are provided. Each flexible plastic clip has a first end and a second free end. The flexible plastic clips are attached at spaced points along the back surface points of the molding strip such that the first end of each clip is attached on the back surface of said molding strip at a point of attachment intermediate the upper free edge and lower free edge of the molding strip. Each clip is capable of flexing relative to the point of attachment to the molding. The molding strip is sufficiently flexible about its length as well as its width to provide conforming engagement of its upper free edge and its lower free edge with the ceiling and vertical wall. A wall track of flexible plastic has a back surface, a front surface, an upper edge and a forward leading edge providing a gap between the leading edge and the front surface. The track is mounted adjacent the upper edge of the track on one of the ceiling and said vertical wall such that the forward leading edge is spaced from the other of the ceiling and the vertical wall. The forward leading edge of said track is capable of flexing relative to the upper free edge of said track. Interengagement is provided on the second free end of the clip and the forward leading edge of said track such that when the thin molding strip with the flexible plastic clips attached thereto is mounted on the track by relative movement, the second free end of the clip is moved into the gap and the forward leading edge of the track is engaged. The thin molding strip is restrained against ready removal when said molding strip is mounted on said wall track, the clip being positioned between the lower forward free edge of the wall track and its associated wall to cause the forward leading edge to flex so that said clip is retained by a snap-in fit and is removable while permitting the upper free edge and lower free edge of said molding strip to flex and conform with the ceiling and vertical wall.

At the juncture of adjacent molding strips, one of the molding strips is provided with a complementary shaped plastic segment spaced from the internal surface of the molding strip to provide a cavity. The other of the molding strips is provided with an axial plastic segment that has a projection of the same configuration adapted to extend into the cavity of an adjacent strip so that adjacent molding strips abut one another with the segment that extends into the cavity of an adjacent strip providing a bridge.

Among the objectives of the present invention are to provide a decorative molding system comprising an improved joint of the type shown in application Ser. No. 08/262,918 including flexible strips which are connected by a joint between adjacent thin molding strips that are provided about the wall of a room; which is readily constructed; which can be readily applied; which can be readily disassembled.

In accordance with the invention the abutting edges of the molding strips are cut at angle to the longitudinal axis such that they are complementary providing a less visible line and thereby providing a more aesthetic appearance.

DESCRIPTION OF A PREFERRED EMBODIMENTS

Figures 1, 2, 3, 4:
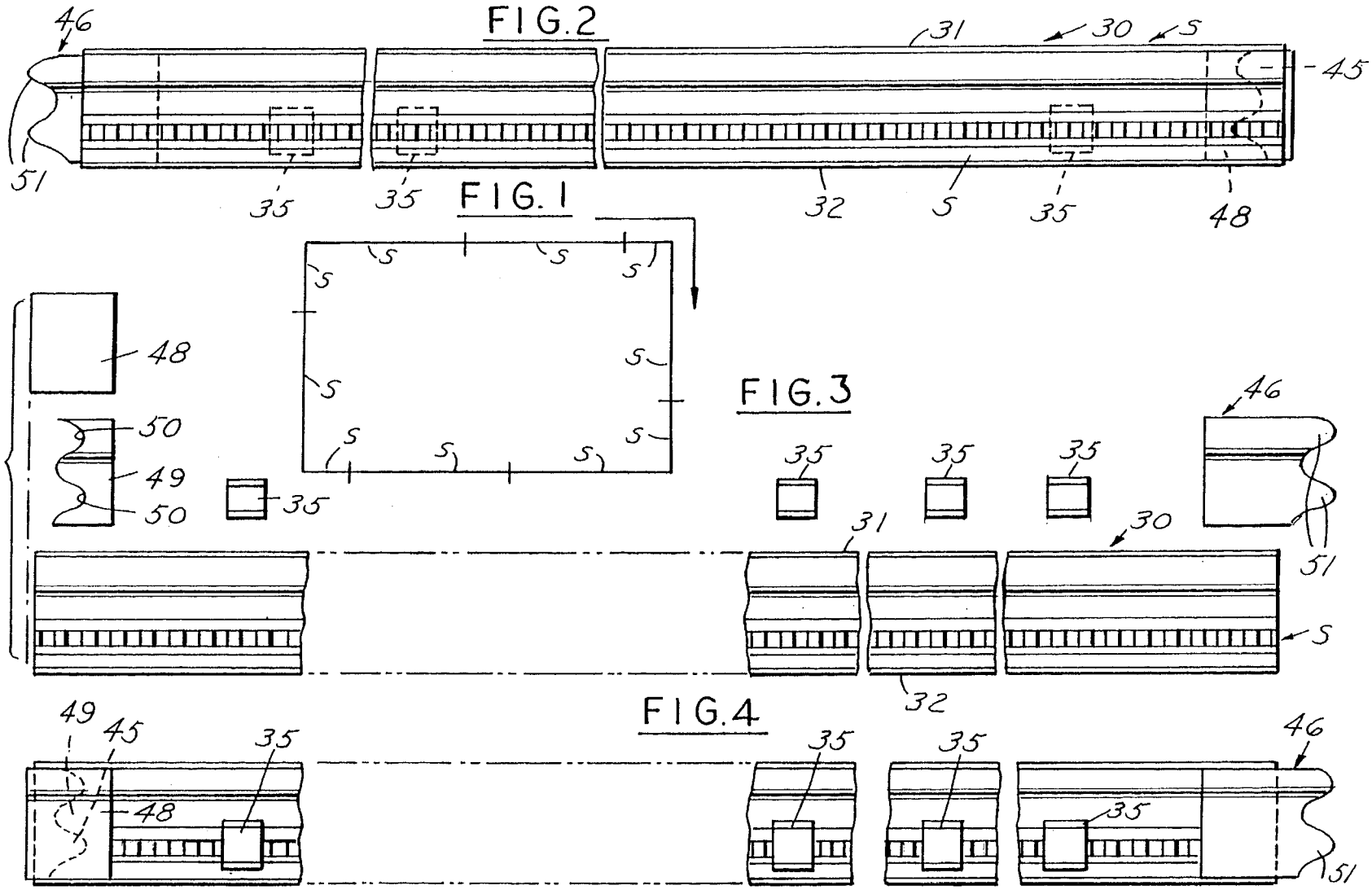
FIG. 1 is a plan diagram of a decorative plastic molding system for a room.
FIG. 2 is a fragmentary front elevational view of a decorative plastic molding strip embodying the invention.
FIG. 3 is a rear exploded view of the decorating strip shown in FIG. 2.
FIG. 4 is a rear assembled view of the strip shown in FIG. 2.

Referring to FIG. 1 which is a planned diagram of a molding system embodying the invention, it can be seen that a plurality of flexible molding strips S are provided about the periphery of the room in an abutting relationship.

In accordance with the invention, a joint is provided between the lengths of strips S along each wall. The joint at the corners is provided, for example, as shown in the aforementioned patent applications, incorporated herein by reference.

Referring to FIGS. 2–13, each strip S comprises a body 30 of flexible plastic material and is preferably formed by vacuum forming in order that the outer surface thereof will have a simulated grain formed in the mold to simulate wood. The strip is made of plastic material such as polystyrene that can be painted or stained as desired.

Figure 12:
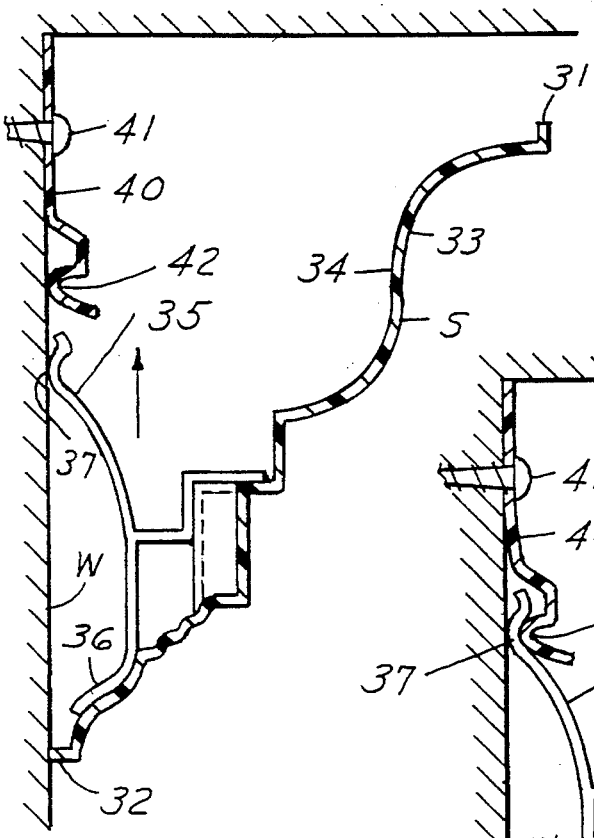
FIG. 12 is a fragmentary sectional view showing the decorative plastic strip being assembled on a track in a room.
Figure 13:
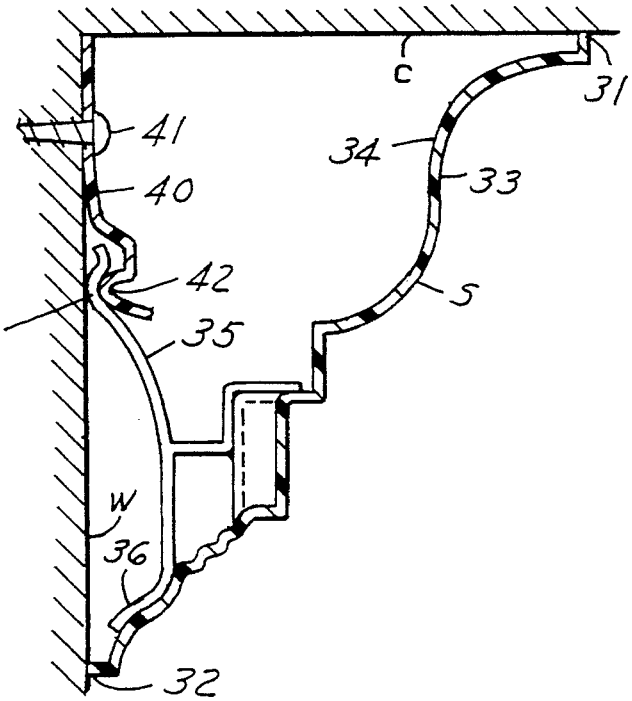
FIG. 13 is a sectional view similar to FIG. 12 showing the strip in assembled relationship to the track, wall and ceiling.
Figure 14:
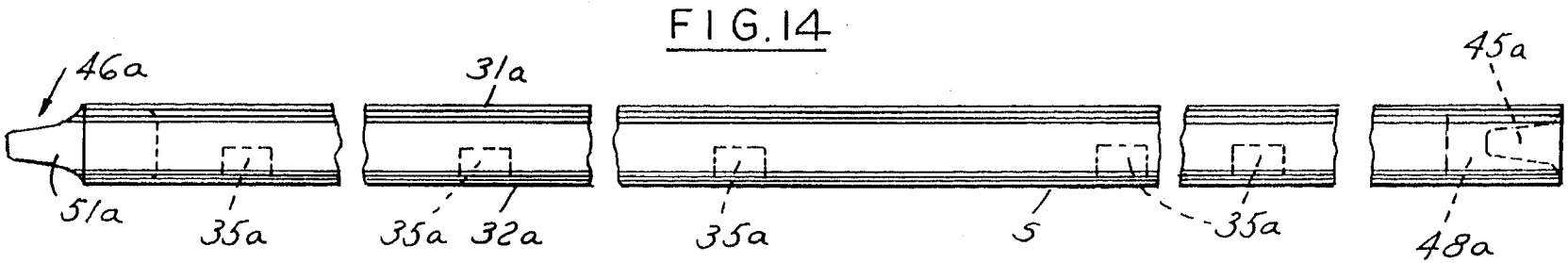
FIG. 14 is a fragmentary front elevational view of a modified form of strip.
Figure 15:
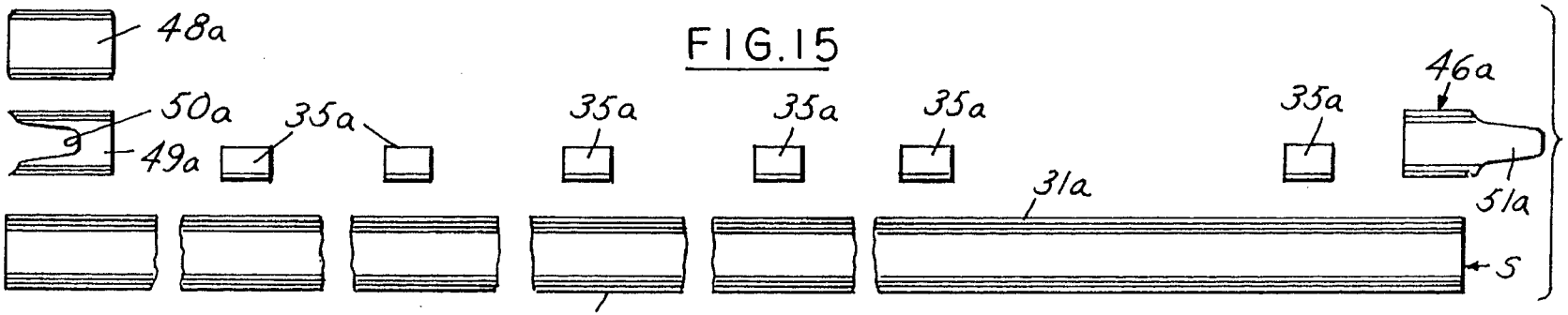
FIG. 15 is a rear exploded view of the strip shown in FIG. 14.
Figure 16:
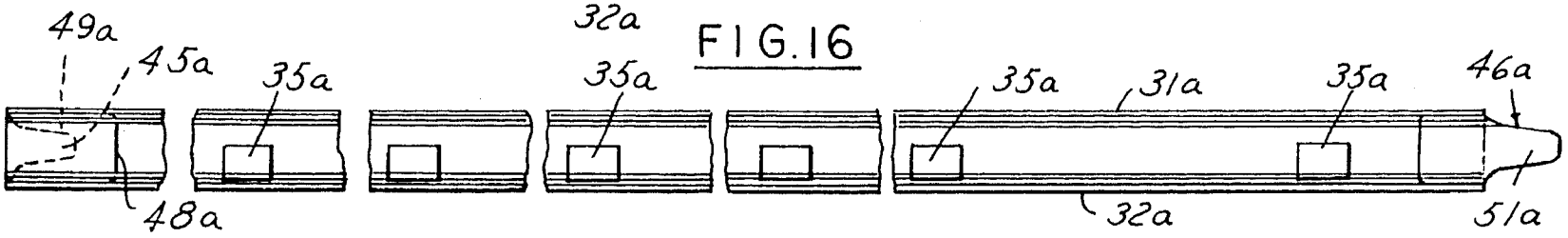
FIG. 16 is an assembled rear view of the strip shown in FIG. 14.
Figures 17, 18, 19:
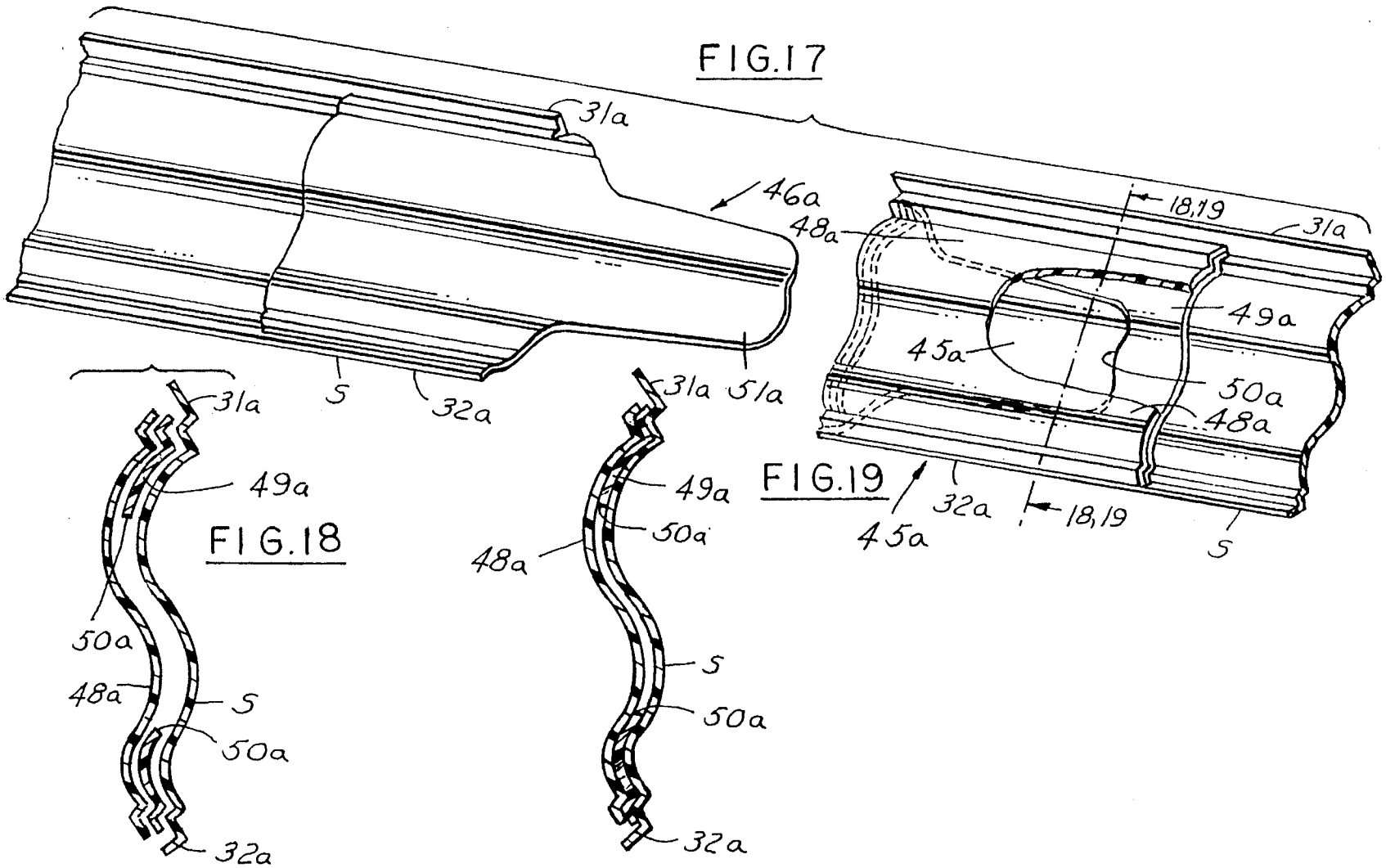
FIG. 17 is a fragmentary exploded view showing the joint between adjacent strips.
FIG. 18 is an exploded view taken along the lines 18—18 in FIG. 17.
FIG. 19 is an assembled sectional view taken along the lines 19—19 in FIG. 17.
Figure 20:
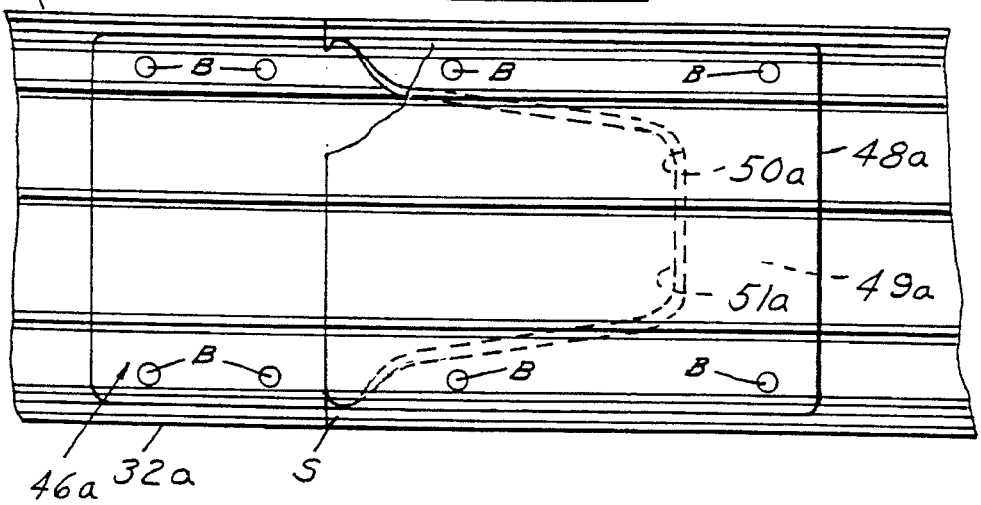
FIG. 20 is a part sectional rear elevational view showing the joint between adjacent flexible strips.
Figure 22:
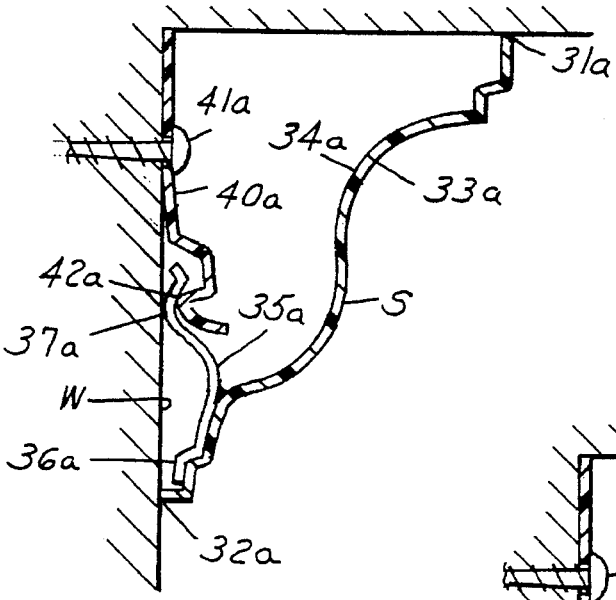
FIG. 22 is a fragmentary sectional view of the decorative strip in assembled relationship to a track, wall and ceiling.
Figure 21:
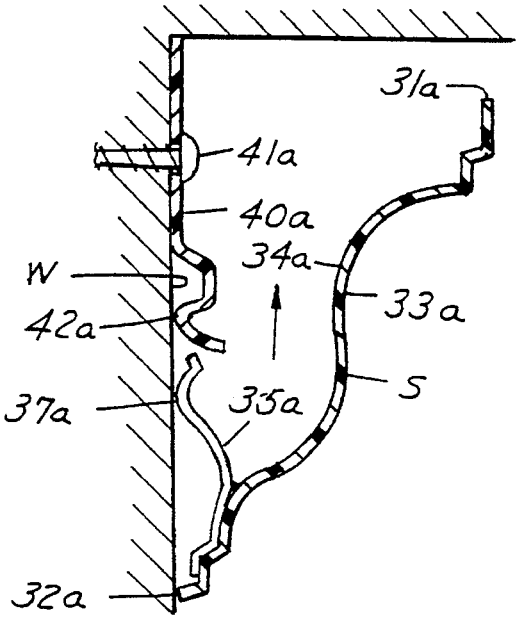
FIG. 21 is a fragmentary sectional view showing the decorative strip of FIGS. 14–20 being assembled on a track in a room.

As shown in FIGS. 12 and 13, the strip S has a configuration herein shown as being what is known in the carpentry trade as a dentil shape cove. In such a configuration, "teeth" T are spaced longitudinally adjacent the lower ends of the strip S prime. The thin molding strip has an upper free edge 31, a lower free edge 32, a front surface 33 and a rear surface 34. The upper free edge 31 is adapted to lie against either a ceiling or wall and flex relative thereto. The lower free edge 32 is adapted to lie against the other of the ceiling or vertical wall and flex relative thereto. A plurality of flexible clips 35 are fixed at longitudinally spaced point along the strip S at the rear surface adjacent the lower edge 32 as by ultrasonic bonding, heat bonding at or by adhesive. Each clip has a first end 36 fixed to the strip and a second free end 37 (FIG. 12, 13). The clips 35 are provided at longitudinally spaced points along the strip S. A track 40 is fastened to the wall W as shown in FIG. 12 as by screws 41 and abuts against the ceiling C. The track 40 has an undulating flexible lower edge 42 which is generally complementary to the upper edge 37 of the clips 35 so that by upward movement in the direction of the arrow as shown in FIG. 12 there is interengagement between the track 40 and the clips 35 holding the upper free edge 31 under tension against the ceiling and the lower free edge 32 against the wall W as shown in FIG. 13.

In accordance with the invention, an axially extending cavity 45 is provided at one end of the strip (FIGS. 2 and 3) and an axial projection 46 is provided at the other end of each strip S.

Figure 5:
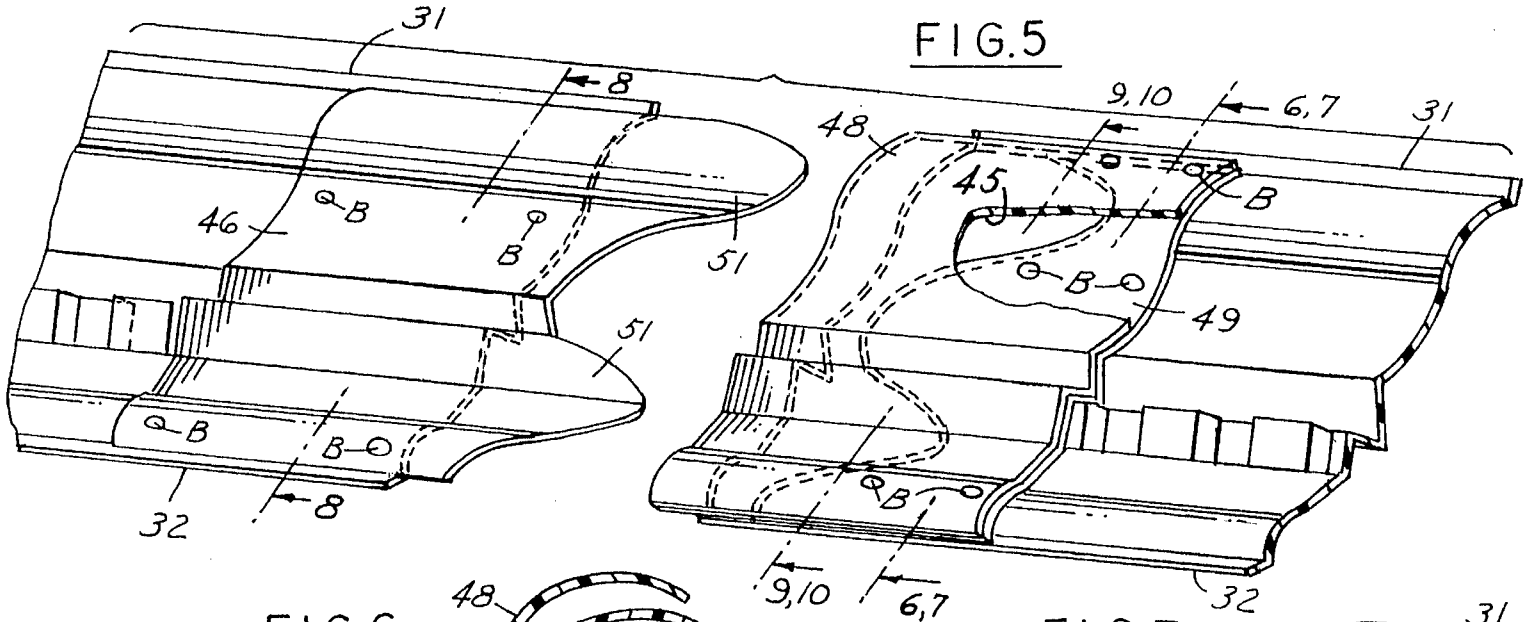
FIG. 5 is a rear exploded perspective view of a joint between adjacent strips.
Figure 7:
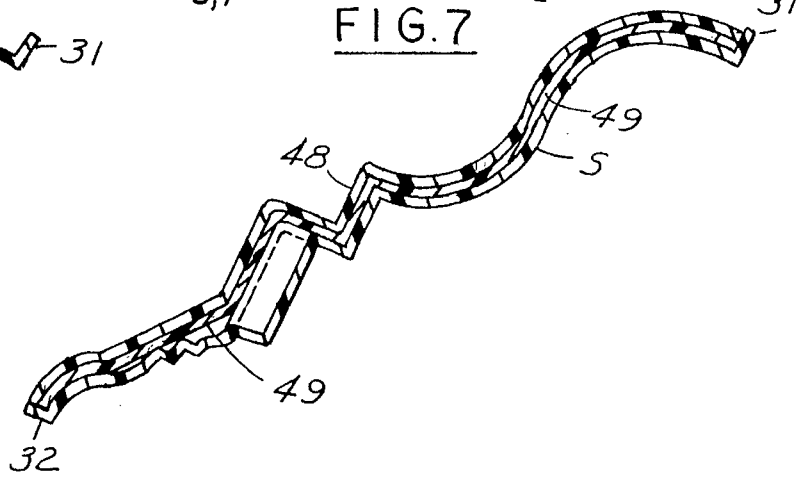
FIG. 7 is a sectional view taken along the lines 7—7 in FIG. 5.
Figure 6:
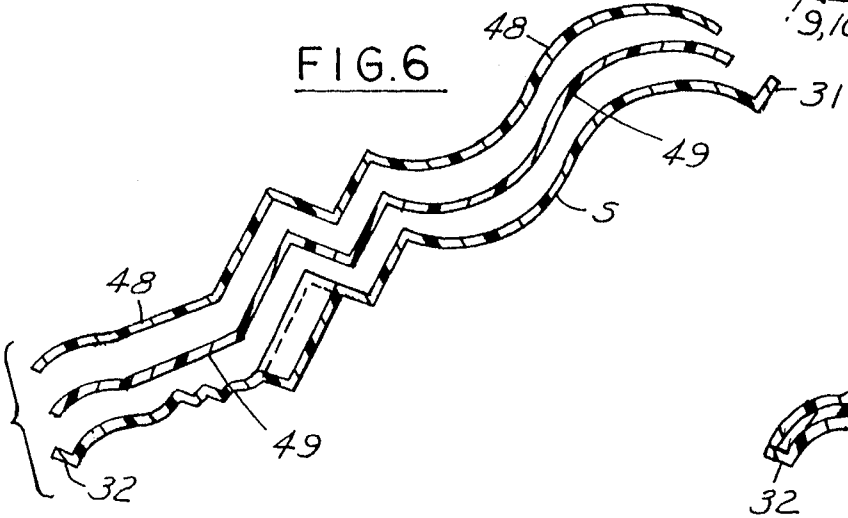
FIG. 6 is a sectional exploded view taken along the lines 6—6 in FIG. 5.
Figure 8:
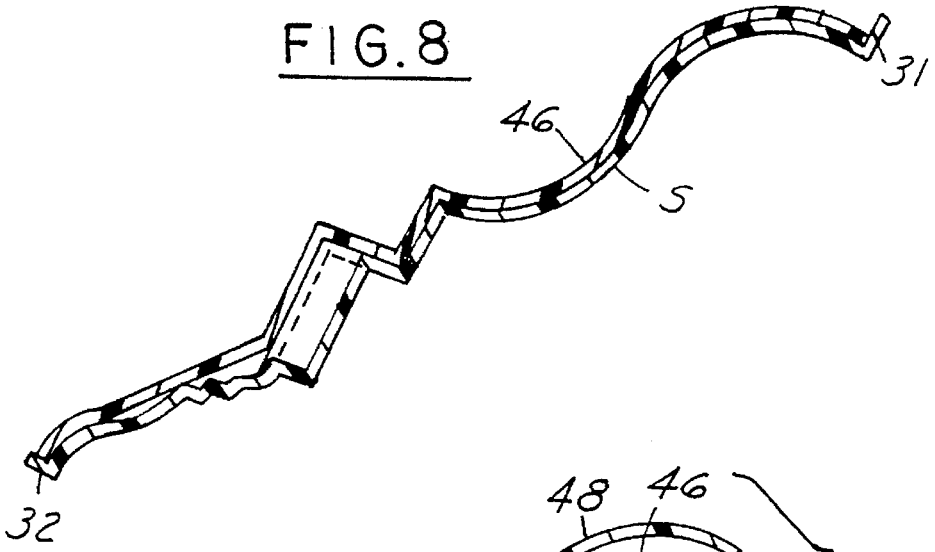
FIG. 8 is a sectional view taken along the line 8—8 in FIG. 5.
Figure 9:
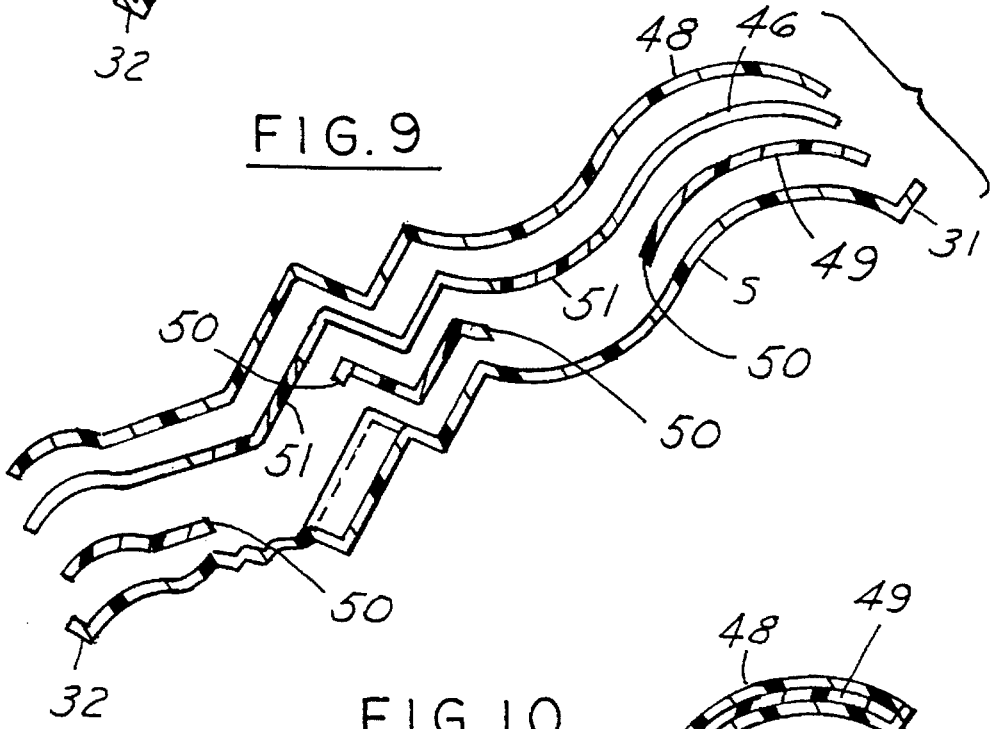
FIG. 9 is an exploded sectional view taken along the line 9—9 in FIG. 5.
Figure 10:
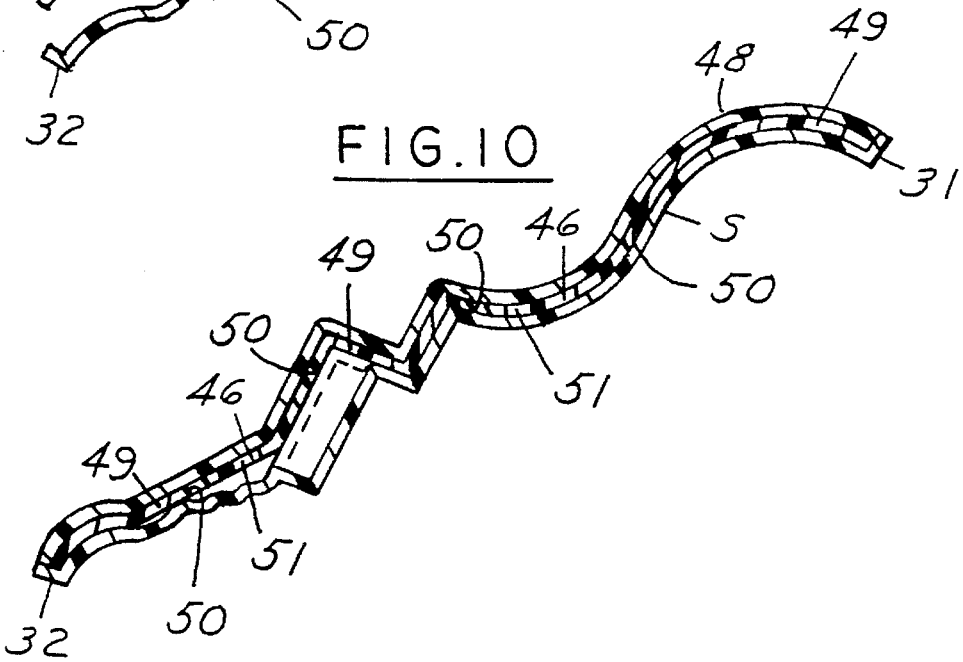
FIG. 10 is an assembled sectional view taken along the line 10—10 in FIG. 5.

Referring to FIGS. 3–7, the cavity 45 is defined by two plastic pieces 48 and 49 which have a general cross-sectional configuration of the strip S as shown in cross section in FIG. 9 which is an exploded view. The piece 49 functions as a spacer which includes two axial slots 50 such that when it is provided on the inside surface of the strip S it defines the cavity 45 in cooperation with the strip S. The axial projection 46 also has the complementary configuration to the inner surface of the strip S and has spaced tips 51 complementary to the piece 49 (FIG. 5). The axial projection 46 is fixed as by ultrasonic welding at B, heat bonding or adhesive to the interior surface of the strip S. Similarly, the pieces 48 and 49 are bonded to the strip S by ultrasonic welding, heat bonding or adhesive.

Figure 11:
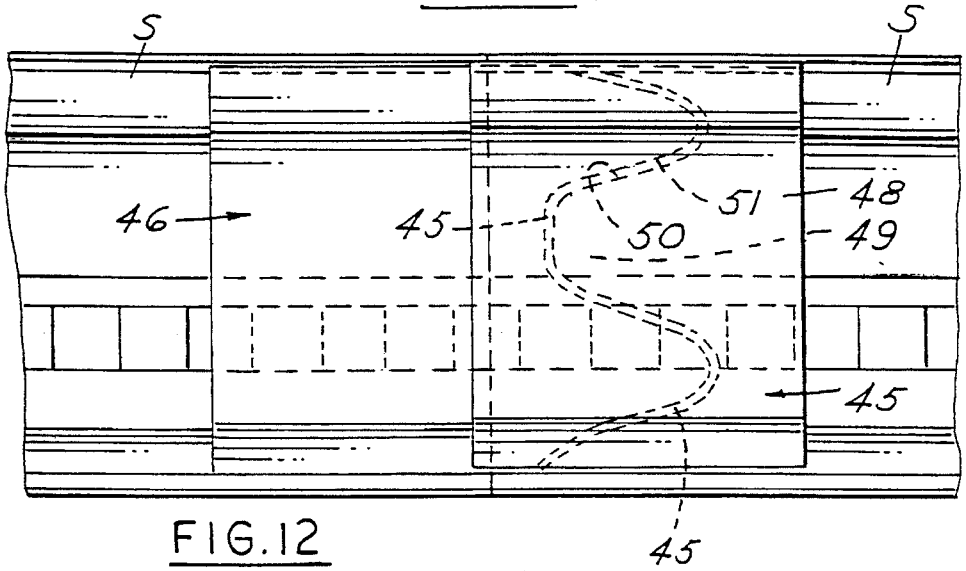
FIG. 11 is a part sectional rear elevated view showing the joint between adjacent flexible strips.

When one strip is assembled with respect to the other, the joint is provided as shown in FIG. 11 which is a rear view assembly of the joint. In accordance with the invention, the space between teeth is such that at each end one-half space is provided whereby when a joint is created by bringing adjacent strips into engagement, the appearance of a equally spacing of teeth is provided between adjacent strips.

In the modified form shown in FIGS. 14–22, the structure is substantially the same except at the configuration of the strips as prime are what is known as ogee shaped in the carpentry trade or a cove.

Otherwise, the construction is substantially the same as shown in FIGS. 2–13, corresponding parts being provided with a suffix "a".

In the modified form of joint shown in FIGS. 23–30, the joint is modified to provide a more aesthetic appearance. This form is substantially the same as that described with reference to FIGS. 14–22, corresponding parts having the same reference numerals. In this form, the abutting edges of the abutting strips are chamfered to form an end surface that is at an acute angle with respect to a plane at a right angle to the longitudinal axis of the strips. The surface 58 on piece **31*a* is formed with a chamfered surface. The surface 56 on the piece 32*a* is complementary to the surface 58 on piece 31*a* on the strip. When the strips an in abutting relation as in FIG. 23**, a thin relatively unobtrusion line is provided thereby providing a more aesthetic appearance.

Figure 23:
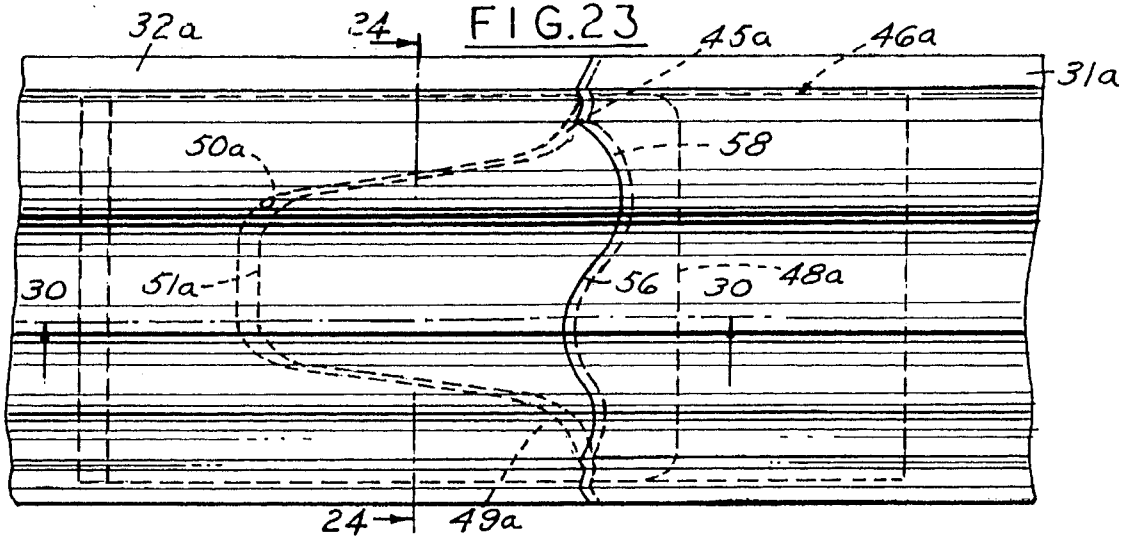
FIG. 23 is a fragmentary front elevational view of a modified form of joint.
Figure 24:
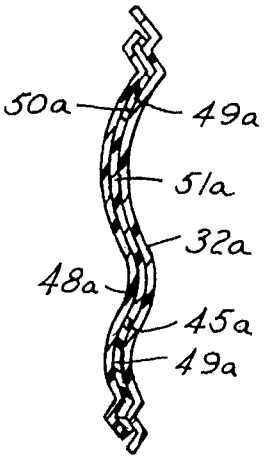
FIG. 24 is a sectional view taken along the line 24—24 in FIG. 23.
Figure 25:
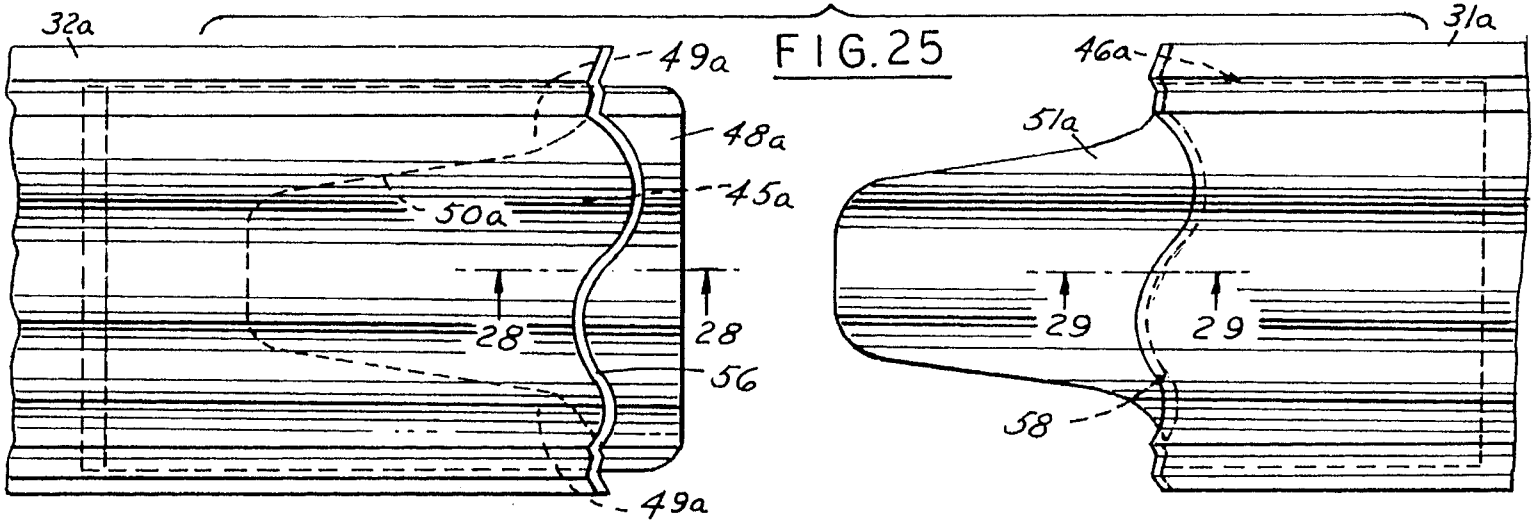
FIG. 25 is an exploded view showing the joint in FIG. 23.
Figure 26:
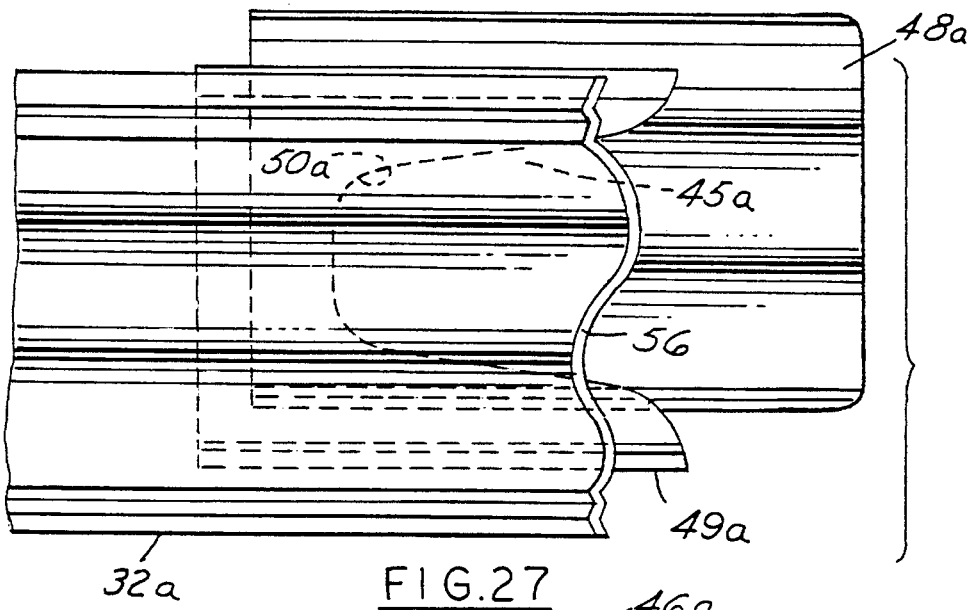
FIG. 26 is an exploded view showing the parts of the left hand part shown in FIG. 25.
Figure 27:
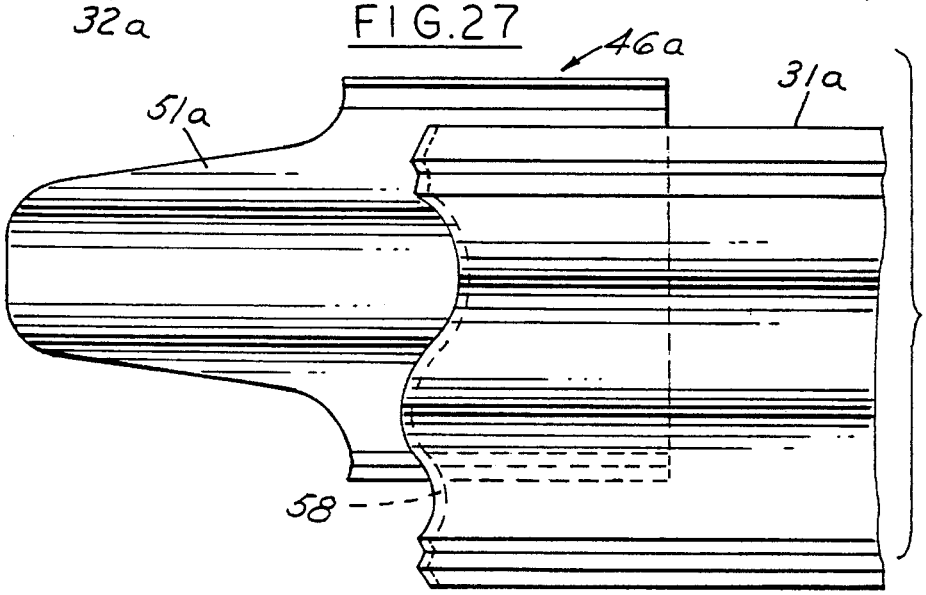
FIG. 27 is an exploded view of left hand part shown in FIG. 25.
Figure 28:
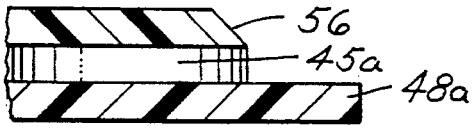
FIG. 28 is a fragmentary sectional view taken along the line 28—28 in FIG. 25.
Figure 29:
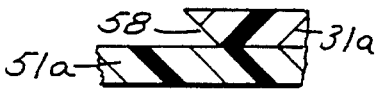
FIG. 29 is a fragmentary sectional view taken along the line 29—29 in FIG. 15.
Figure 30:
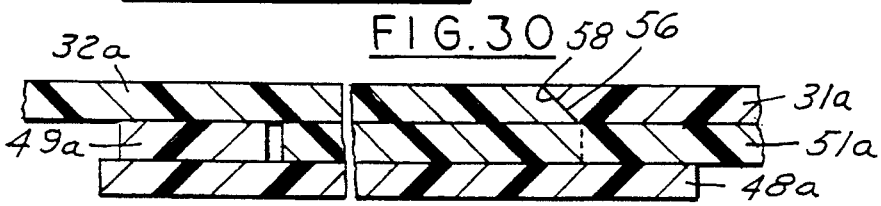
FIG. 30 is a fragmentary sectional view taken along the line 30—30 in FIG. 23.

FIG. 23 is a front elevational view showing the manner in which the abutting edges of the molding strips can be modified to provide a more aesthetic appearance.

It can thus be seen that there has been provided a decorative molding system which comprises a joint between a joint between adjacent thin molding strips that are provided about the wall of a room; which is readily constructed; which can be readily applied; which can be readily disassembled.

What is claimed is:

1. A decorative molding system removably installed at a juncture of a ceiling and a vertical wall, said molding system comprising:

a plurality of thin molding strips of flexible plastic having a length and an upper free edge, a lower free edge, a front surface and a back surface, said upper free edge being adapted to lie against one of said ceiling and said vertical wall along a line spaced from the juncture of the ceiling and vertical wall and flex relative thereto, said lower free edge being adapted to lie against the other of said ceiling and said vertical wall along a line spaced from the juncture of the ceiling and vertical wall and flex relative thereto, a plurality of flexible plastic clips, each said flexible plastic clip having a first end and a second free end, said flexible plastic clips being attached at spaced points along the length of the back surface of each molding strip such that the first end of each said clip is attached on the back surface of said molding strip at a point of attachment intermediate the upper free edge and lower free edge of said molding strip and said second free end of each said clip extends at an angle from said point of attachment, said second free end of each said clip being capable of flexing relative to said point of attachment to said molding, each said molding strip being sufficiently flexible about its length as well as its width to provide conforming engagement of its upper free edge and its lower free edge with the ceiling and vertical wall to provide conforming engagement with the ceiling and vertical wall, a plurality of wall tracks of thin flexible plastic having a back surface, a front surface, an upper edge and a forward leading edge providing a gap between the leading edge and the front surface, means for mounting the upper edge of each track on one of said ceiling and said vertical wall adjacent the juncture of said ceiling and said vertical wall such that said forward leading edge is spaced from the other of said ceiling and said vertical wall, said forward leading edge of said track being capable of flexing relative to said upper edge of said track, interengaging means on said second free end of said clip and said forward leading edge of said track such that when the thin molding strip with the flexible plastic clips attached thereto is mounted on said track by movement of each said second free end of each said clip into the gap between the leading edge of said track and the front surface, the second free end of each said clip is moved into the gap and said forward leading edge of said track are interengaged, such that each said thin molding strip is restrained against ready removal and such that when said molding strip is mounted on said wall track, the upper edge of said molding strip is angled outwardly from said track, such that said clip is positioned between said lower forward free edge of said wall track and its associated wall to cause the forward leading edge to flex so that said clip is retained by a snap-in fit and is removable while permitting the upper free edge and lower free edge of said molding strip to flex into conforming engagement with the ceiling and vertical wall, each said molding strip having an axial projection at one end and an axial projection receiving cavity at the other end, said projection on one end being received in a cavity of an adjacent molding strip.

2. The decorative molding system set forth in claim 1 wherein said projection comprises a plastic member having a similar cross section to that of the molding and being bonded thereto at one end of said strip, each cavity being formed with a pair of adjacent plastic members having a similar cross section to that of said strip and bonded to the other end of said strip, the one member which is adjacent said strip having a portion defining said cavity between the other member and said strip.

3. The decorative molding system set forth in claim 2 wherein said molding strips have a dentil shape cross section.

4. The decorative molding system set forth in claim 1 wherein said molding strips have an ogee cross section.

5. The decorative molding system set forth in any one of claims 1–4 wherein said molding strips, clips, projections and tracks are made of substantially the same thickness of plastic.

6. The decorative molding system set forth in claim 5 wherein the free edges of the abutting strips are chamfered.

7. The decorative molding system set forth in claim 6 wherein said chamfered edges comprise complementary planar surfaces.

8. The decorative molding system set forth in claim 7 wherein said edges surfaces are an acute angle to the axis of their respective strips.

9. A decorative molding system removably installed at a juncture of a ceiling and a vertical wall, comprising a plurality of thin molding strips of flexible plastic having a length and an upper free edge, a lower free edge, a front surface and a back surface, said upper free edge being adapted to lie against one of said ceiling and said vertical wall along a line spaced from the juncture of the ceiling and vertical wall and flex relative thereto, said lower free edge being adapted to lie against the other of said ceiling and said vertical wall along a line spaced from the juncture of the ceiling and vertical wall and flex relative thereto, a plurality of flexible plastic clips, each said flexible plastic clip having a first end and second free end, said flexible plastic clips being attached at spaced points along the length of the back surface of each molding strip such that the first end of each said clip is attached on the back surface of said molding strip at a point of attachment intermediate the upper free edge and lower free edge of said molding strip and said second free end of each said clip extends at an angle from said point of attachment, said second free end of each said clip being capable of flexing relative to said point of attachment to said molding, each said molding strip being sufficiently flexible about its length as well as its width to provide conforming engagement of its upper free edge and its lower free edge with a ceiling and a vertical wall to provide conforming engagement with a ceiling and a vertical wall, a plurality of wall tracks of thin flexible plastic having a back surface, a front surface, an upper edge and a forward leading edge providing a gap between the leading edge and the front surface, means for mounting the upper edge of each track on one of a ceiling and a vertical wall adjacent the juncture of a ceiling and a vertical wall such that said forward leading edge is spaced from the other of a ceiling and a vertical wall, said forward leading edge of said track is capable of flexing relative to said upper edge of said track, interengaging means on said second free end of said clip and said forward leading edge of said track such that when the thin molding strip with the flexible plastic clips attached therein mounted on said track by movement of each said second free end of each said clip into the gap and said forward leading edge of a track are interengaged, such that each said thin molding strip is restrained against ready removal and such that when said molding strip is mounted on a wall track, the upper edge of said molding strip is angled outwardly from said track, such that said clip is positioned between said lower forward free edge of said wall track and its associated wall to cause the forward free edge of said wall track and its associated wall to cause the forward leading edge to flex so that said clip is retained by a snap-in fit and is removable while permitting the upper free edge and lower free edge of said molding strip to flex into conforming engagement with a ceiling and a vertical wall, the improvement wherein the connection between aligned molding strips comprises each said molding strip having an axial projection one end and an axial projection receiving cavity at the other end, said projection on one end being received in a cavity of an adjacent molding strip.

10. The decorative molding system set forth in claim 9 wherein said projection comprises a plastic member having a similar cross section to that of the molding and being bonded thereto at one end of said strip, each cavity being formed with a pair of adjacent plastic members having a similar cross section to that of said strip and bonded to the other end of said strip, the one member which is adjacent said strip having a portion defining said cavity between the other member and said strip.

11. The decorative molding system set forth in claim 9 wherein said molding strips have a dentil shape cross section.

12. The decorative molding system set forth in claim 9 wherein said molding strips have an ogee cross section.

13. The decorative molding system set forth in any one of claims 9–12 wherein said molding strips, clips, projections and tracks are made of substantially the same thickness of plastic.

14. The decorative molding system set forth in claim 13 wherein the free edges of the abutting strips are chamfered.

15. The decorative molding system set forth in claim 14 wherein said chamfered edges comprise complementary planar surfaces.

16. The decorative molding system set forth in claim 15 wherein said edges surfaces are an acute angle to the axis of their respective strips.

* * * * *